US008384527B2

(12) United States Patent
Irwin

(10) Patent No.: US 8,384,527 B2
(45) Date of Patent: Feb. 26, 2013

(54) PORTABLE AND PERSONAL ALARM CLOCK SYSTEM

(76) Inventor: Maureen Irwin, Wyandotte, MI (US)

( * ) Notice: Subject to any disclaimer, the term of this patent is extended or adjusted under 35 U.S.C. 154(b) by 182 days.

(21) Appl. No.: 13/074,473

(22) Filed: Mar. 29, 2011

(65) Prior Publication Data

US 2011/0235469 A1 Sep. 29, 2011

Related U.S. Application Data

(60) Provisional application No. 61/318,458, filed on Mar. 29, 2010.

(51) Int. Cl.
*G08B 1/00* (2006.01)

(52) U.S. Cl. ..... 340/309.16; 340/539.11

(58) Field of Classification Search ..... 340/309.16, 340/539.11; 368/10, 12
See application file for complete search history.

(56) References Cited

U.S. PATENT DOCUMENTS

| | | | | |
|---|---|---|---|---|
| 4,777,474 | A | 10/1988 | Clayton | |
| 4,821,247 | A | 4/1989 | Grooms | |
| 5,894,455 | A | 4/1999 | Sikes | |
| 6,008,720 | A | 12/1999 | Hongu et al. | |
| 6,906,983 | B2 | 6/2005 | Williams et al. | |
| 7,042,338 | B1 * | 5/2006 | Weber | 340/309.5 |
| 2002/0181336 | A1 | 12/2002 | Shields | |

* cited by examiner

*Primary Examiner* — Shirley Lu
(74) *Attorney, Agent, or Firm* — RG Patent Consulting LLC; Rachel Gilboy

(57) ABSTRACT

A portable and personal alarm clock system which incorporates the use of wireless technology to wake a person up through a personal earpiece alarm. This device comprises two main components including an earpiece alarm and a receiving base. The earpiece alarm is integrated with a small rechargeable battery and charging portal and is designed to automatically turn on after removing from receiving base. The receiving base resembles an electric alarm clock having an LED face, two speakers, a snooze button, buttons for setting the clock and alarm, and an alarm sound selector function. There is a charging means for the earpiece(s) and a volume control for the ear piece and base speakers. The base could also include a backup power source.

2 Claims, 6 Drawing Sheets

PORTABLE AND PERSONAL ALARM CLOCK SYSTEM

CROSS-REFERENCE TO RELATED APPLICATION

The present application is related to and claims priority from prior provisional application Ser. No. 61/318,458, filed Mar. 29, 2010 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field Of The Invention

The present invention relates generally to the field of alarm clocks and more specifically relates to a portable and personal alarm clock system.

2. Description Of The Related Art

Many people in modern society are part of the large sector termed "the workforce." Each country has a working sector of the population that is predominantly accredited with creation of the country's gross national product. In modern industrialized societies, rigid schedules are kept by large and small companies to keep up with production level requirements. Alarm clocks may be used to awaken people who otherwise might over-sleep, preventing them from arriving late for work.

Many individuals use alarm clocks to wake them for work or other activities. Modern digital alarm clocks often feature a radio alarm function and/or a beeping or buzzing alarm, allowing a sleeper to awaken at a predetermined time. Most also offer a "snooze button", a large button often located on the top of the clock that stops the alarm from sounding and sets it to ring again after a short duration. The primary use of these clocks is to awaken people from their night's sleep or short naps; they are sometimes used for other reminders as well. To stop the sound from being emitted, a button or handle on the clock is pressed; further most clocks automatically stop the alarm sound if left unattended for a lengthy duration.

A classic analog alarm clock traditionally has an extra hand or inset dial that is used to specify the time at which to activate the alarm. Mechanical alarm clocks may have one or two bells that ring by means of a mainspring that drives a gear that propels a hammer back and forth between the two bells or between the interior sides of a single bell. In some models, the back encasement of the clock itself acts as the bell. In an electric bell-style alarm clock, the bell is actuated by an electromagnetic circuit and armature that turns the circuit on and off repeatedly. Different versions of digital alarm clocks can make other sounds. Simple battery-powered alarm clocks may make a loud buzzing or beeping sound to wake a sleeper.

A progressive alarm clock can have different alarms for different times. Most modern cell phones have alarm clock functions to turn on or make sounds at specified times.

Problems may exist for example when a husband and wife or various members of a family have different work shift or school schedules, wherein traditional alarm clocks may awaken other family members, creating an unnecessary disruption. One member can be awakened for work while unintentionally waking other members of a family and cutting short their required sleep time. Present embodiments do not take this into consideration.

Various attempts have been made to solve the above-mentioned problems such as those found in Pub. Nos. 2002/0181336; U.S. Pat. Nos. 5,894,455; 6,008,720; 4,821,247; 6,906,983; and U.S. Pat. No. 4,777,474. This prior art is representative of alarm-sounding devices. None of the above inventions and patents, taken either singularly or in combination, is seen to describe the invention as claimed.

Ideally, a portable and personal alarm clock system should be user-friendly and, yet, would operate reliably and be manufactured at a modest expense. Thus, a need exists for a reliable, portable, and personal alarm clock system to awaken a specified user and to avoid the above-mentioned problems.

BRIEF SUMMARY OF THE INVENTION

In view of the foregoing disadvantages inherent in the known alarm clock art, the present invention provides a novel portable and personal alarm clock system. The general purpose of the present invention, which will be described subsequently in greater detail, is to provide a user-specific waking means.

The portable and personal alarm clock system as disclosed subsequently herein preferably comprises: a master alarm clock base unit having a wireless transmitter for transmitting short wavelength radio transmissions and at least one slave removable ear-piece having a wireless receiver, the devices in communication with each other. The slave removable ear-piece may use frequency-hopping spread spectrum and preferably operates on a packet-based protocol using a master-slave structure.

The slave removable ear-piece(s) are wearable during sleeping periods and contain sound emitters for the audibly transferred alarm tone to awaken the user at a preset time. The master alarm clock base may contain integral speakers that can audibly sound to awaken anyone within hearing distance or can wake only the person wearing the slave removable ear-piece(s) (in transmit mode.) The user may prefer/select to wake to music from a radio station, a pre-recorded compilation of songs, a monotone buzzing noise, and/or an audible message. The master alarm clock base unit and the slave removable ear-piece(s) are preferably in communication within a master-slave structured piconet such that a first wearer-user is able to receive a first audible sound in the slave removable ear-piece that is unheard by a second wearer-user (or non-wearer-user.) In a like manner, if desired, a second wearer-user is able to hear a selected alarm sound that is unable to be heard by the first wearer-user.

The master alarm clock base is preferably in wireless communication with the slave removable ear-piece(s) such that the transmitter in master alarm clock base is able to send at least one audible-alarm-signal to the selected receiver as a wake up alert. The master alarm clock base unit is able to be programmed to signal at least one wireless receiver wherein each of the slave removable ear-pieces is able to receive radio transmissions from the master alarm clock base unit. The radio signals may operate on frequency-hopping spread spectrum. The data being sent is transmitted on up to 79 bands (1 MHz each) in the range 2402-2480 MHz using 2.0+EDR (basic rate), π/4-DQPSK or 8DPSK modulation (enhanced data rate), or in combination "BR/EDR radio." This range is in the globally unlicensed Industrial, Scientific and Medical (ISM) 2.4 GHz short-range radio frequency band.

The master alarm clock base unit may also be in communication with an internet enabled mobile phone in certain embodiments, wherein the internet enabled mobile phone, using an application, is able to remotely program the master alarm clock base unit.

The slave removable ear-piece(s) preferably has an alarm volume adjustment that can be set for each user's preference. The slave removable ear-piece(s) contain and are preferably powered by at least one rechargeable battery that can be placed on a recharge docking station on the master alarm clock base unit for recharging the slave removable ear-piece' (s) rechargeable batteries. The slave removable ear-piece(s) may comprise ear buds in certain embodiments. The master alarm clock base unit programmably and digitally displays time on the proximate end (outward face) such that a user may easily view the time.

The portable and personal alarm clock system preferably incorporates the use of wireless technology to wake at least one person through a personal earpiece alarm. The earpiece alarm can be shaped like an in-the-ear hearing aid that should be almost invisible to the observer. It can utilize a sleek design with a small integrated rechargeable battery and charging portal and should not require any buttons or other bulky features. Alternately, the ear-piece(s) may take different physical forms and may be designed to be automatically turned on after being removed from the receiving base. Other versions could incorporate a volume adjustment on the ear-piece as well as a volume adjustment on the base unit.

The receiving base may resemble an electric alarm clock preferably having an LED face, a plurality of speakers, a snooze button, buttons (means) for setting the clock and alarm, and an alarm sound selector function. A charging dock for the earpiece may also be located on top of the base unit. The base unit preferably may include a backup power source for when power outages occur. Additionally, as mentioned, this device may be compatible with a smart phone application that allows users to set the receiver base functions through a cell phone.

A computer application provided on CD within the kit (subsequently detailed) of the present invention may be uploaded to a cell phone through a USB cord or via the Internet, for programming set times or alarm types, alarm tones or other within the alarm clock base unit/transmitter. This function allows the alarm to be more portable and versatile.

A method of use for a portable and personal alarm clock system is also disclosed herein generally including the steps of: setting a first and/or a second programmed alarm time for at least one wakeup alarm for a first user and/or for a second user, using the digital display on the master alarm clock base unit. The first and second users wearing the slave removable ear-piece(s) while sleeping and upon activation of the first programmed alarm time, the first user is awakened with audible tones unheard by the second user. Upon activation of the second programmed alarm time, the second user is awakened with audible tones unheard by the first user, then the first or second user may shut off the wakeup alarm and re-set the wakeup alarm(s), and insertably-recharging the slave removable ear-piece(s)—the last two steps (and others) being optional.

Portable and personal alarm clock system 100 may be sold as kit 440 comprising the following parts: at least one master alarm clock base unit; at least one slave removable ear-piece; and one set of user instructions.

The present invention holds significant improvements and serves as a portable and personal alarm clock system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, portable and personal alarm clock system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an alarm clock system device and more particularly to a portable and personal alarm clock system 100 as used to improve individual-specified waking means.

Figure 1:
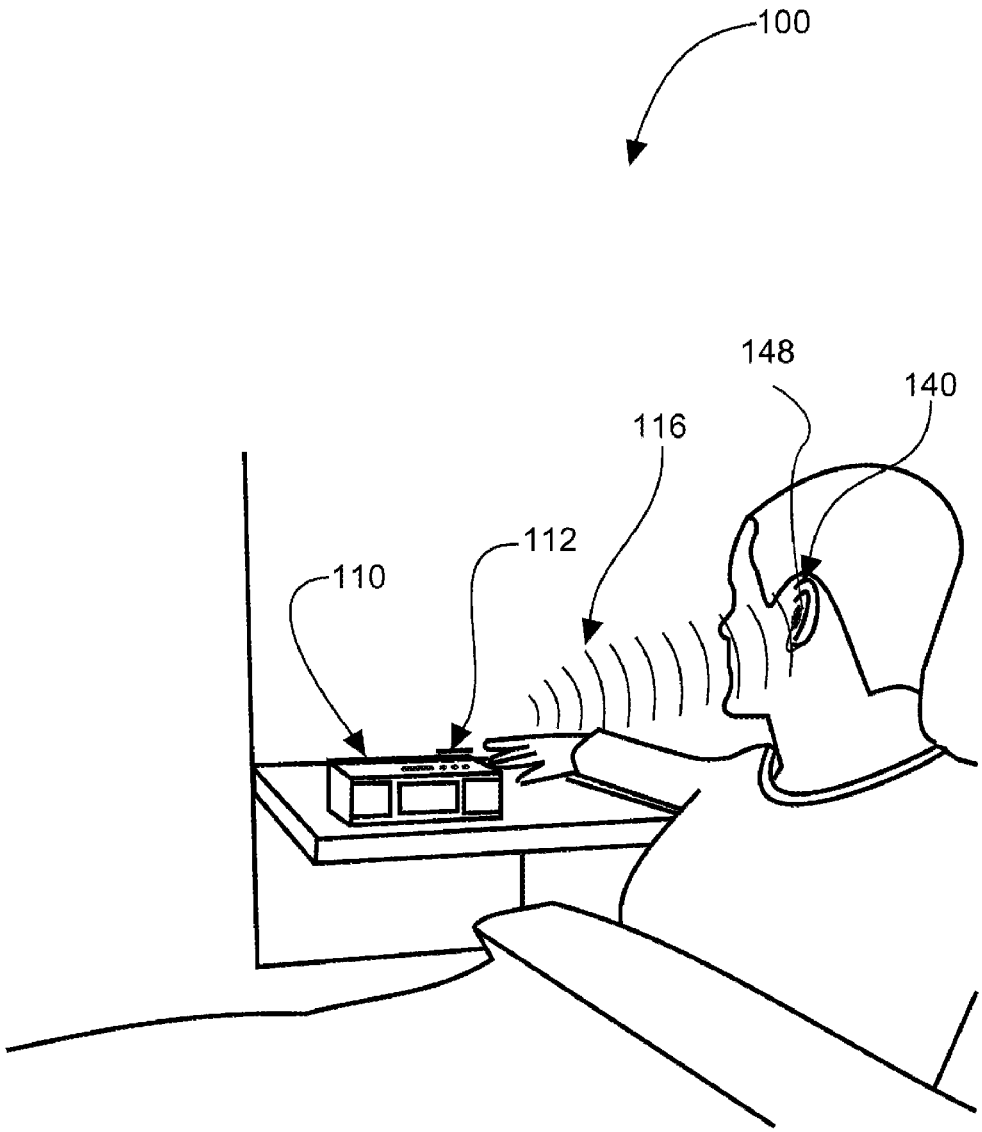
FIG. 1 shows a perspective view illustrating a portable and personal alarm clock system in an in-use condition according to an embodiment of the present invention.

Referring more specifically to the drawings by numerals of reference there is shown in FIG. 1, a perspective view illustrating portable and personal alarm clock system 100 in an in-use condition according to an embodiment of the present invention.

Master alarm clock base unit 110 as shown preferably comprises wireless transmitter 102 for transmitting short wavelength radio transmissions 122 such that users may be wakened at alternate intervals, yet being in close proximity. Master alarm clock base unit 110 is preferably in communication with slave removable ear-piece(s) 140. Slave removable ear-piece(s) 140 may use a frequency-hopping spread within a packet-based protocol using a master-slave structure.

Master alarm clock base unit 110 preferably includes integral speakers 112 having audible transfer ability; at least one slave removable ear-piece 140 (for a user to wear similar in structure/function to a Bluetooth®, hearing aid, ear bud or the like) having a wireless receiver 148 for receiving audible sounds; slave removable ear-piece(s) 140 preferably having sound emitters allowing a wake up alert in the form of music from a radio station, music from a pre-recorded compilation of songs, an audible pre-recorded message(s), or a monotone buzzing noise to be heard by the user-wearer. Using a selector switch 143 on the master alarm clock base unit 110 the user can choose to have audible signals 116 emitted via either integral speakers 112 or via slave removable ear-piece(s) 140, and select the desired type of wake up alert.

Figure 2:
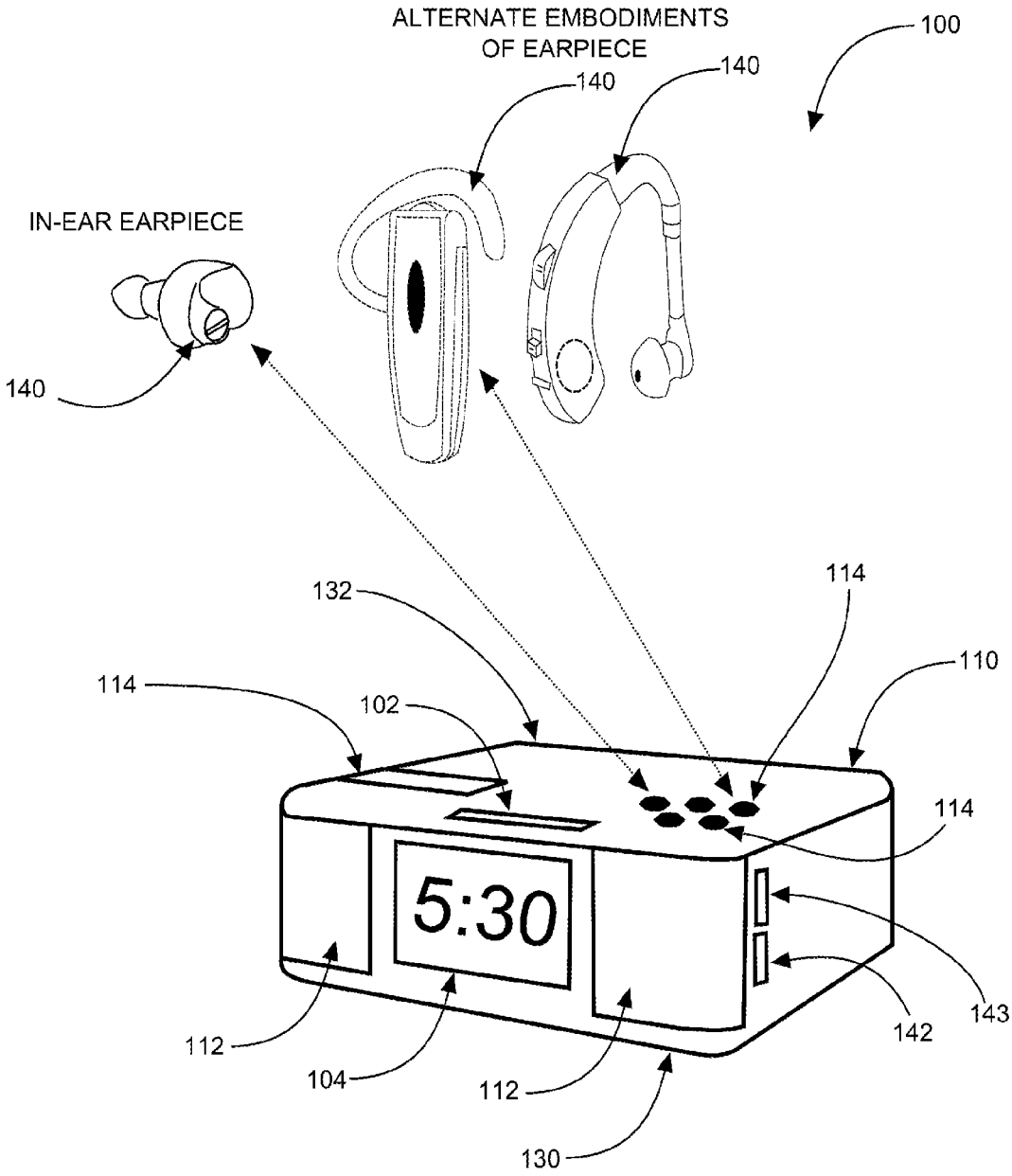
FIG. 2 is a perspective view illustrating a master alarm clock base unit and least one slave removable ear-piece having a wireless receiver according to an embodiment of the present invention of FIG. 1.
Figure 5A:
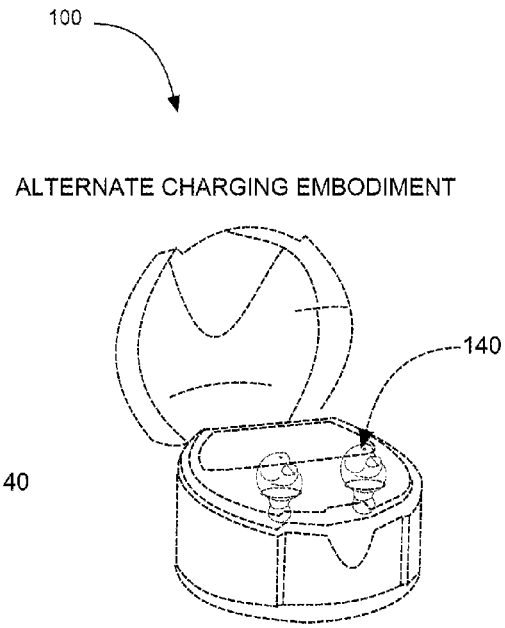
FIG. 5A is a perspective view illustrating an alternate charging dock for the slave removable ear-pieces.

Referring now to FIG. 2, a perspective view illustrating master alarm clock base unit 110 and least one slave removable ear-piece(s) 140 having a wireless receiver 148 according to an embodiment of the present invention of FIG. 1. Portable and personal alarm clock system 100 master alarm clock base unit 110 may be in communication with an internet enabled mobile phone and may be programmed remotely with an internet enabled mobile phone, as discussed previously. Master alarm clock base unit 110 preferably comprises at least one charging dock 114 for insertably-receiving and charging rechargeable battery(s) 144 of slave removable ear-piece(s) 140, also detailed in FIG. 5B. FIG. 5A shows a perspective view illustrating an alternate charging dock for slave removable ear-pieces 140. Rechargeable batteries 144 may also be charged via other suitable battery charging means.

Figure 3:
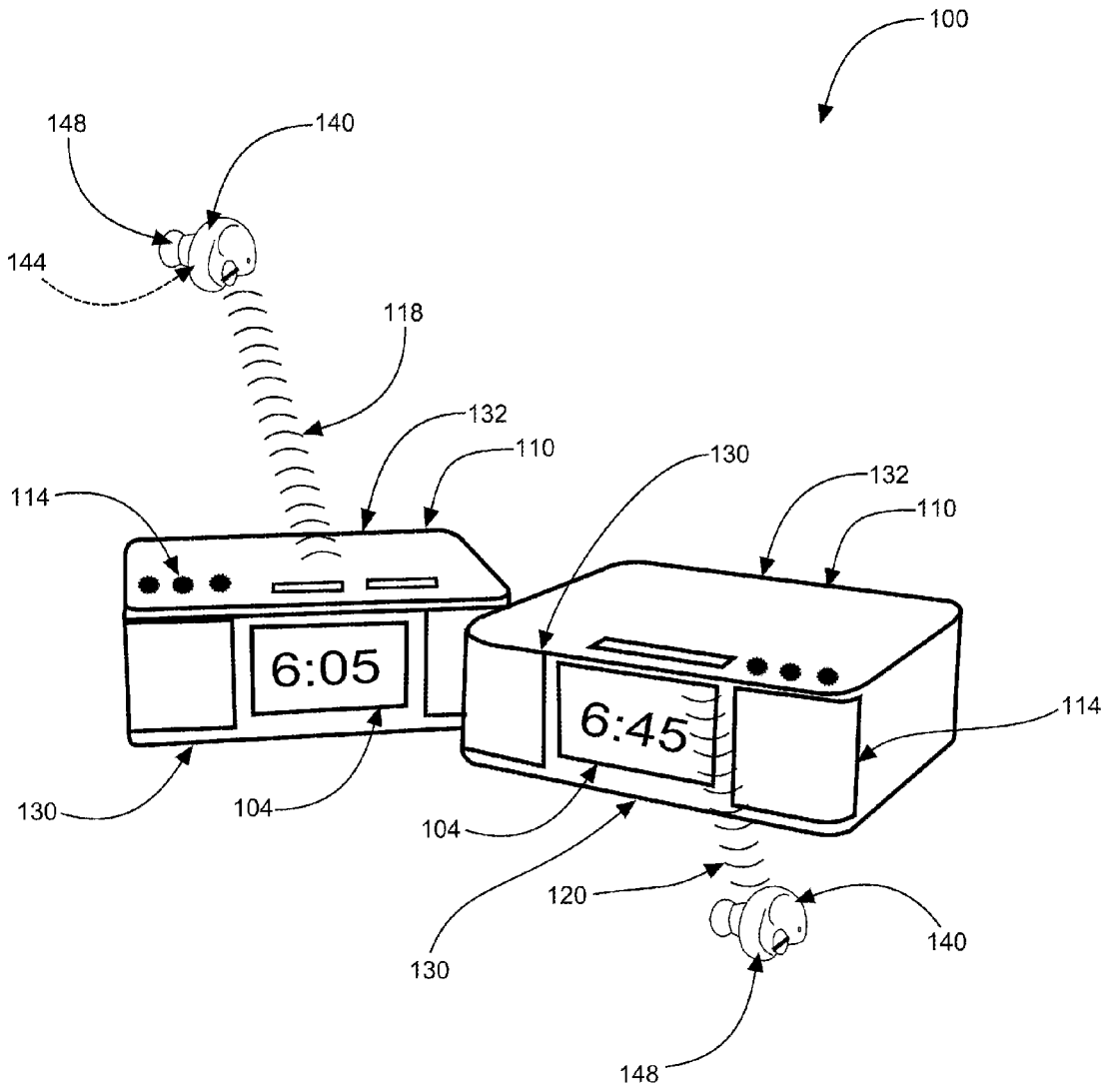
FIG. 3 is a perspective view illustrating the master alarm clock base unit transmitting alarms sounds to at least one slave removable ear-piece having a wireless receiver at different periods according to an embodiment of the present invention of FIG. 1.

Referring now to FIG. 3, a perspective view illustrating master alarm clock base unit 110 transmitting alarm sounds to at least one slave removable ear-piece(s) 140 having a wireless receiver 148 at different times/periods/durations according to an embodiment of the present invention of FIG. 1. Master alarm clock base unit 110 and slave removable ear-piece(s) 140 are in communication within a master-slave structured piconet, using frequency-hopping spread spectrum, a packet-based protocol with a master-slave structure in this particular embodiment. The preferred radio signals may operate on frequency-hopping spread spectrum. The data being sent is transmitted on up to 79 bands (1 MHz each) in the range 2402-2480 MHz using 2.0+EDR (basic rate), $\pi/4$-DQPSK or 8DPSK modulation (enhanced data rate), or in combination "BR/EDR radio." This range is in the globally unlicensed Industrial, Scientific and Medical (ISM) 2.4 GHz short-range radio frequency band. Master alarm clock base unit 110 is able to be programmed to signal at least one wireless receiver 148 of a condition (alarm time or other.) In accordance, slave removable ear-piece(s) 140 are able to receive radio transmissions from master alarm clock base unit 110. Additionally, slave removable ear-piece(s) 140 may incorporate an alarm volume adjustment 142. Master alarm clock base unit 110 programmably digitally displays time and preferably comprises integral speakers 112 having audible transfer ability to work in conjunction or alternately to slave removable ear-piece(s) 140 (if not worn.) In this way the present invention may be used with or without slave removable ear-piece(s) 140 to provide alarming/wake-up means.

Figure 4:
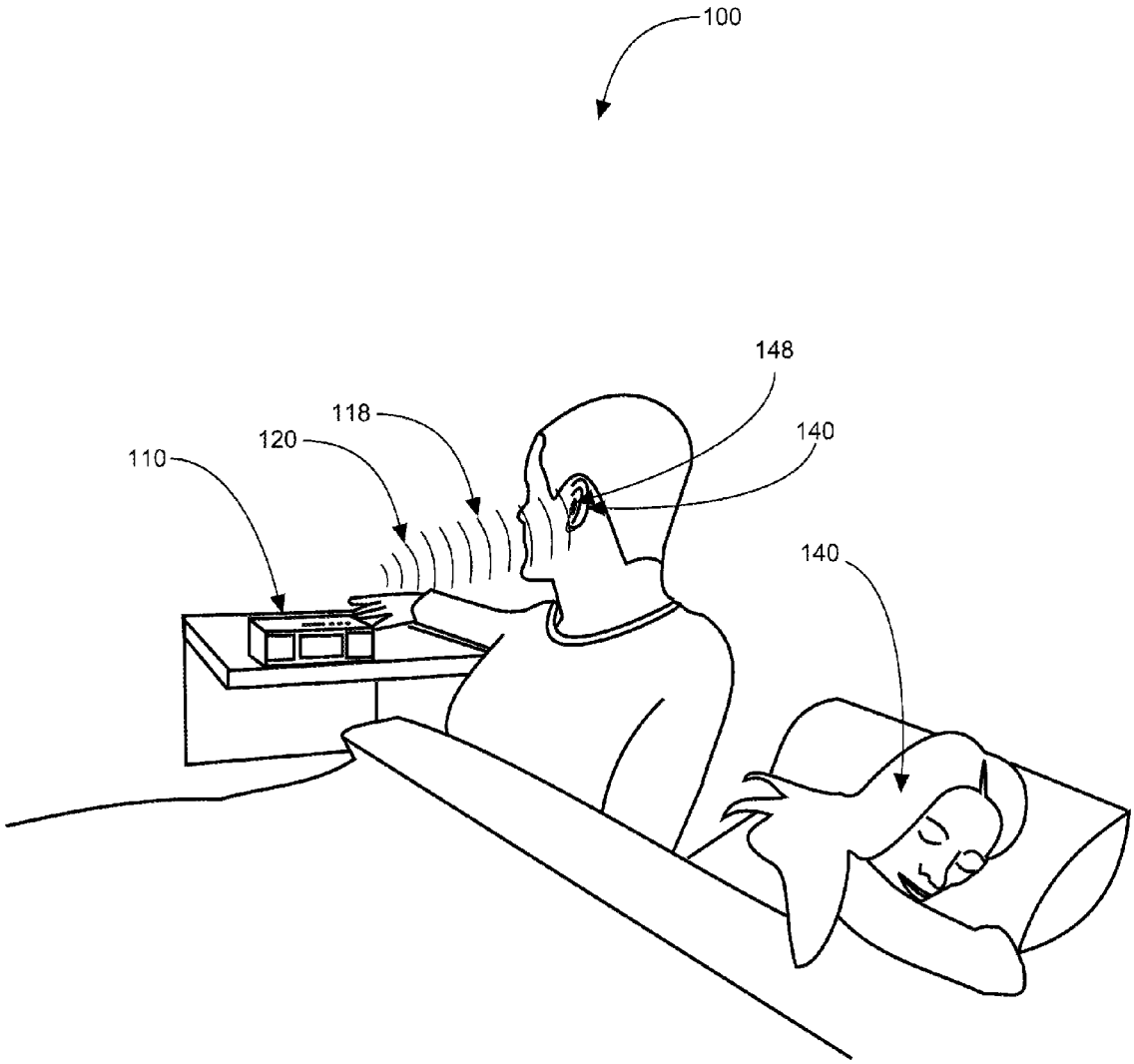
FIG. 4 is a perspective view illustrating an alarm sounding for a first user without disturbing a second user in close proximity, according to an embodiment of the present invention of FIG. 1.

Referring now to FIG. 4, showing a perspective view illustrating the alarm sounding for a first user without disturbing a second person (user) in close proximity, according to an embodiment of the present invention of FIG. 1. A first wearer-user is able to receive a first emitted audible signal 116 such that a second wearer-user is unable to hear first emit audible signal(s) 116. In a similar way second wearer-user is able to receive a second emitted audible signal(s) 116 such that the first wearer-user is unable to hear second emit audible signal(s) 116. In this way the present invention may selectively wake certain individuals without disturbing others. Master alarm clock base unit 110 is preferably in wireless communication with slave removable ear-piece(s) 140 such that the transmitter is able to send at least one audible-alarm-signal (transmission) to the receiver wherein the audible-alarm-signal is a wake up alert. Slave removable ear-piece(s) 140 may be worn during sleeping periods to comfortably facilitate the alarming means. Wake up alert played may comprise music from a radio station or from a pre-recorded compilation of songs, at least one audible message(s), or a monotone buzzing noise.

The portable and personal alarm clock system 100 disclosed herein preferably comprises master alarm clock base unit 110 having a wireless transmitter 118 for transmitting short wavelength radio transmissions and at least one slave removable ear-piece(s) 140 having a wireless receiver 148 for receiving the transmissions/signals. Slave removable ear-piece(s) 140, as previously mentioned preferably uses frequency-hopping spread spectrum and operates on a packet-based protocol within a master-slave structure. It should be appreciated that other protocols, structures and frequency means may be used and still be considered to be within the scope of the present disclosure.

Slave removable ear-piece(s) 140 are worn/wearable during sleeping periods and contain sound emitters for the audibly transferred alarm tone to wake the user at a preset time. Master alarm clock base unit 110 contains integral speakers 112 that can audibly sound to wake virtually anyone within hearing distance or can wake only the person wearing the slave removable ear-piece(s) 140 when in transmit mode.

Slave removable ear-piece(s) 140 may have an alarm volume adjustment 142 that can be set for each user's preference. Slave removable ear-piece(s) 140 may contain and are preferably powered by at least one rechargeable battery 144 such that slave removable ear-piece(s) 140 can be placed on a charging dock 114 on the master alarm clock base unit 110 for recharging rechargeable battery(s) 144 within slave removable ear-piece(s) 140. The master alarm clock base unit 110 programmably and digitally displays time on the proximate end 130 (face.)

Portable and personal alarm clock system 100 may comprise a kit 440 having master alarm clock base unit 110; at least one slave removable ear-piece(s) 140; and a set of user instructions (not shown.) Portable and personal alarm clock system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5B:
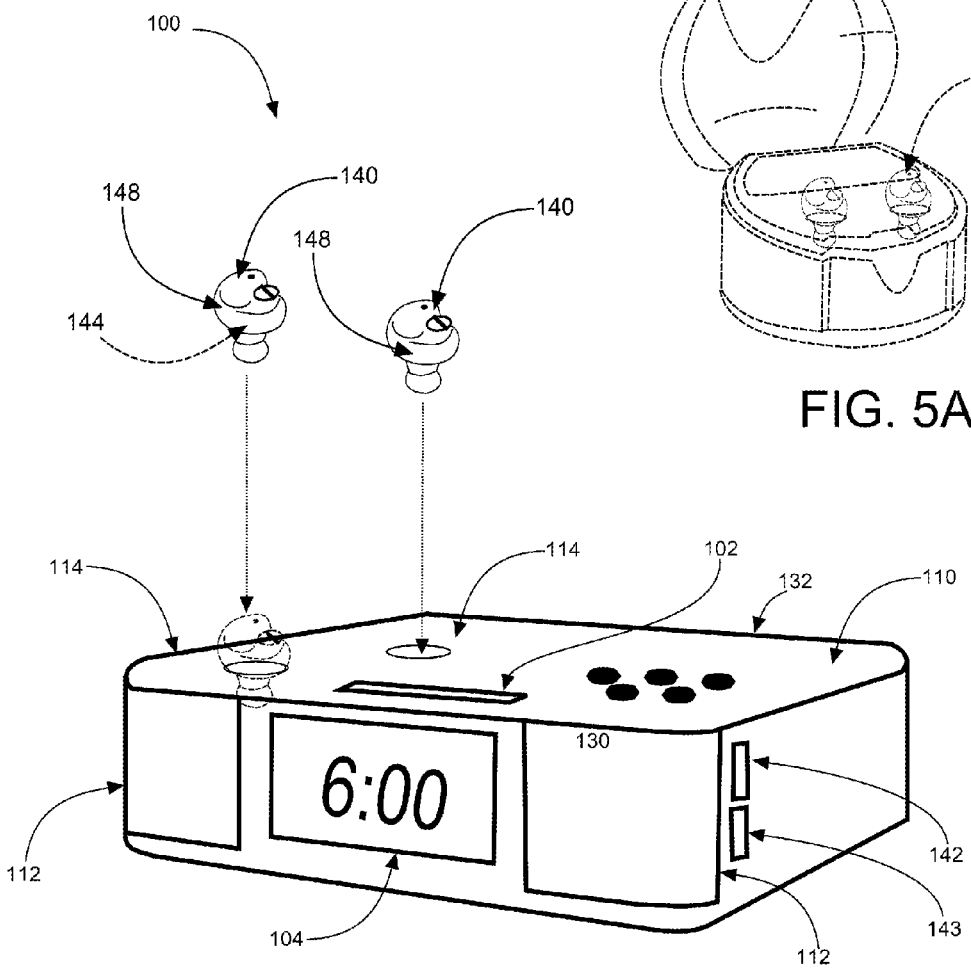
FIG. 5B is a perspective view illustrating charging docks for the slave removable ear-pieces located in the master alarm clock base unit, according to an embodiment of the present invention of FIG. 1.

Referring now to FIG. 5A shows a perspective view illustrating an alternate charging dock for slave removable ear-pieces 140. FIG. 5B is a perspective view illustrating charging docks for slave removable ear-piece(s) 140 located in master alarm clock base unit 110, according to an embodiment of the present invention of FIG. 1. Charging docks may used to recharge batteries in slave removable ear-piece(s) 140. In this way AC power may be suitably converted to DC power such that slave removable ear-piece(s) 140 may be used repeatedly.

Figure 6:
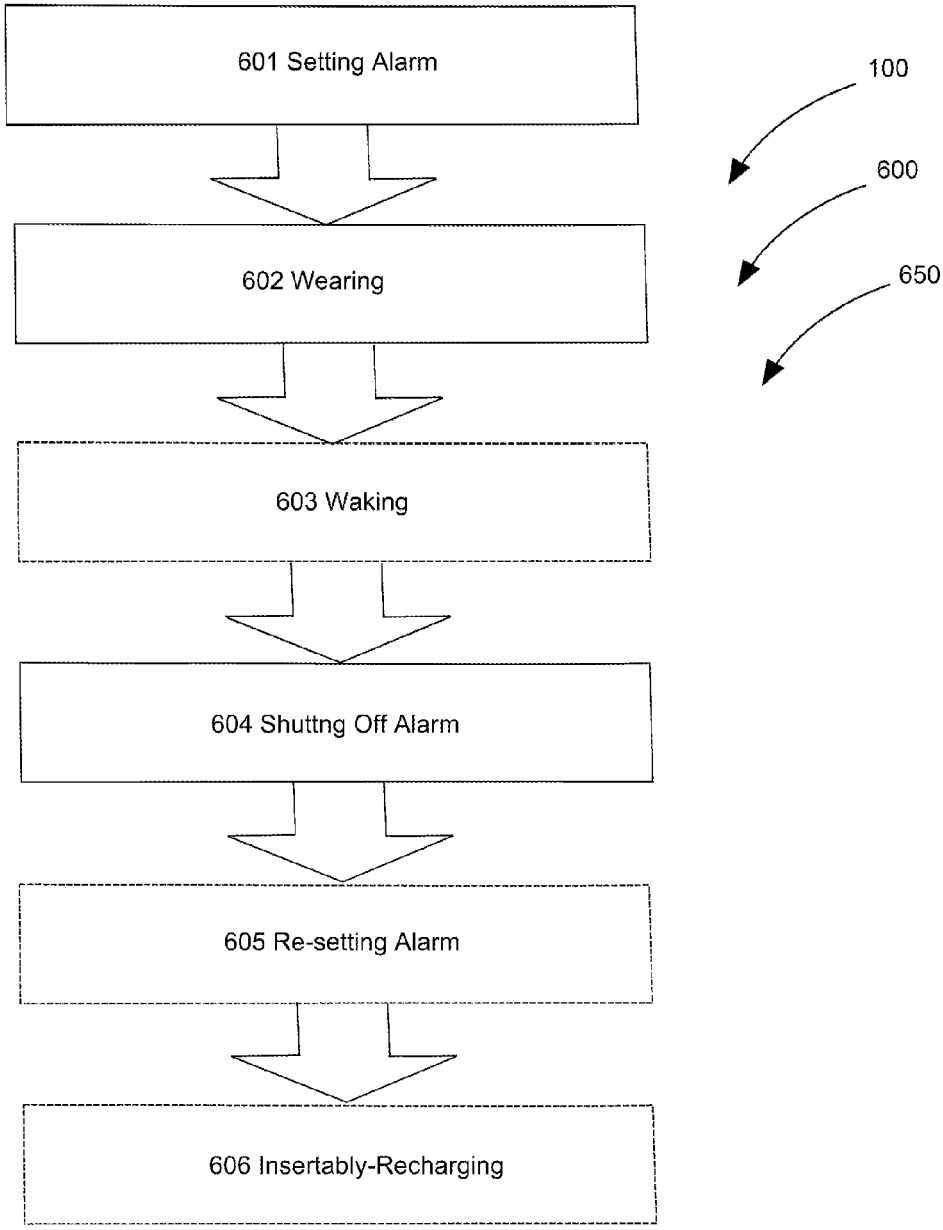
FIG. 6 is a flowchart illustrating a method of use according to an embodiment of the present invention of FIGS. 1-5B.

Referring now to FIG. 6 showing a flowchart 650 illustrating a method of use 600 according to an embodiment of the present invention of FIGS. 1-5B. A method of use 600 for a portable and personal alarm clock system 100 may comprise the steps of: step one 601 setting a first and a second programmed alarm time for at least one wakeup alarm for a first user and for a second user, using digital display 104 on master alarm clock base unit 110; step two 602 first and second users wearing slave removable ear-piece(s) 140 while sleeping—upon activation of the first programmed alarm time, the first user is awakened with audible tones unheard by the second user; step three 603 optionally, upon activation of the second programmed alarm time, the second user is awakened with audible tones unheard by the first user; step four 604 shutting off the wakeup alarm; step five 605 re-setting the wakeup alarm(s); and step six 606 insertably recharging slave removable ear-piece(s) 140 for a future use.

It should be noted that steps 603, 605 and 606 are optional steps and may not be implemented in all cases. Optional steps of method 600 are illustrated using dotted lines in FIG. 6 so as to distinguish them from the other steps of method 600.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A portable and personal alarm clock system comprising:

a master alarm clock base unit having a wireless transmitter for transmitting short wavelength radio transmissions;

at least one slave removable ear-piece having a wireless receiver;

at least one rechargeable battery;

wherein said slave removable ear-piece uses a frequency-hopping spread spectrum;

wherein said slave removable ear-piece uses packet-based protocol with a master-slave structure;

wherein said slave removable ear-piece is worn during sleeping periods;

wherein said master alarm clock base comprises integral speakers having audible transfer ability;

wherein said slave removable ear-piece(s) comprise sound emitters;

wherein said wake up alert comprises music from a radio station or from a pre-recorded compilation of songs, or at least one audible message(s), or a monotone buzzing noise;

wherein said master alarm clock base unit and said slave removable ear-piece(s) are in communication within a master-slave structured piconet such that a first wearer-user is able to receive a first audible signal such that a second wearer-user is unable to hear said first audible signal and wherein said second wearer-user is able to receive a second audible signal such that said first wearer-user is unable to hear said second audible signal;

wherein said master alarm clock base is in wireless communication with said slave removable ear-piece such that said transmitter is able to send at least one audible-alarm-signal to said receiver wherein said audible alarm signal is a wake up alert;

wherein said master alarm clock base unit is able to be programmed to signal at least one wireless receiver;

wherein each of said slave removable ear-pieces receives radio transmissions from said alarm clock base unit;

wherein said master alarm clock base unit is in communication with an internet enabled mobile phone;

wherein said internet enabled mobile phone, using an application, is able to remotely program said master alarm clock base unit;

wherein said slave removable ear-piece has an alarm volume adjustment;

wherein said slave removable ear-piece contains and is powered by said rechargeable battery;

wherein said master alarm clock base unit comprises at least one charging dock for insertably-receiving said slave removable ear-piece(s); and wherein said master alarm clock base unit programmably digitally displays time; and wherein said master alarm clock base is able to emit audible signals via either said integral speakers or via said slave removable ear-piece(s) to provide said wake up alert.

2. The portable and personal alarm clock system of claim 1 comprising a kit having said master alarm clock base unit; said at least one slave removable ear-piece; and a set of user instructions.

* * * * *